US007573385B2

(12) United States Patent
Tonelli

(10) Patent No.: US 7,573,385 B2
(45) Date of Patent: Aug. 11, 2009

(54) PORTABLE CARRYALL CONTAINER WITH IDENTIFIABLE CONTENTS

(75) Inventor: Massimo Tonelli, Casalecchio di Reno (IT)

(73) Assignee: G.T. Line - S.r.l., Crespellano (IT)

( * ) Notice: Subject to any disclaimer, the term of this patent is extended or adjusted under 35 U.S.C. 154(b) by 100 days.

(21) Appl. No.: 11/331,146

(22) Filed: Jan. 13, 2006

(65) Prior Publication Data

US 2006/0170558 A1 Aug. 3, 2006

(30) Foreign Application Priority Data

Jan. 19, 2005 (IT) ..... BO2005A0027

(51) Int. Cl.
*G08B 13/14* (2006.01)

(52) U.S. Cl. ..... 340/568.7; 340/568.2; 340/568.4; 340/570; 340/567; 340/571; 340/572.8; 340/539.32

(58) Field of Classification Search ..... 340/568.7, 340/570, 567, 571, 572.1, 572.4, 572.8, 539.32, 340/568, 568.2, 568.4
See application file for complete search history.

(56) References Cited

U.S. PATENT DOCUMENTS

| | | | | |
|---|---|---|---|---|
| 6,522,253 | B1 * | 2/2003 | Saltus | 340/571 |
| 6,724,306 | B1 * | 4/2004 | Parsley et al. | 340/568.1 |
| 2002/0165758 | A1 * | 11/2002 | Hind et al. | 705/10 |
| 2003/0011476 | A1 * | 1/2003 | Godfrey | 340/572.8 |
| 2004/0075554 | A1 * | 4/2004 | Yang | 340/539.32 |
| 2006/0094399 | A1 * | 5/2006 | Dupont | 455/410 |
| 2006/0103505 | A1 * | 5/2006 | Hulvey | 340/10.2 |

* cited by examiner

*Primary Examiner*—Tai T Nguyen
(74) *Attorney, Agent, or Firm*—Modiano & Associati; Albert Josif; Daniel J. O'Byrne

(57) ABSTRACT

A portable carryall container with identifiable contents, comprising at least one first half-shell and one second half-shell, which are mutually coupled so as to form a compartment for accommodating items and are movable with respect to each other from at least one open configuration to a closed configuration, the portable carryall container comprising at least one transponder, which is suitable to be activated by an appropriately provided reader with a radio frequency signal, the reader being provided at at least one fixed station and being connected functionally to a processing unit, so as to decode the information stored in the transponder and related to the identification of the container and of its contents.

8 Claims, 2 Drawing Sheets

PORTABLE CARRYALL CONTAINER WITH IDENTIFIABLE CONTENTS

The present invention relates to ta portable carryall container with identifiable contents.

BACKGROUND OF THE INVENTION

The need is currently felt, in the most disparate sectors and fields of application, to be able to locate and identify precisely a portable container (such as suitcases, trunks and the like) and its contents, particularly when it passes through certain environments, or during its controlled and monitored transit from one environment to another, for example due to storage logistics reasons or also and especially due to security reasons. Consider, merely by way of example, the transit of suitcases and trunks in airports or upon entering certain environments or buildings which are critical in terms of security.

Problems of this type are usually solved for example by resorting to metal detectors, which require the preparation of suitable facilities with high costs and considerable space occupation; in other cases it is instead necessary to open in each instance the container in order to examine its contents carefully.

SUMMARY OF THE INVENTION

The aim of the present invention is to solve the above-cited drawbacks and meet the mentioned requirements, by providing a portable carryall container which allows its precise identification and the monitoring of its contents rapidly and reliably.

Within this aim, an object of the present invention is to provide a portable carryall container which is manufactured simply and in a substantially traditional manner.

Another object of the present invention is to provide a carryall portable container with identifiable contents which is extremely flexible and versatile in use.

Another object of the present invention is to provide a portable carryall container which is simple, relatively easy to provide in practice, safe in use, effective in operation, and has a relatively low cost.

This aim and these and other objects which will become better apparent hereinafter are achieved by the present portable carryall container with identifiable contents, of the type which comprises at least one first half-shell and one second half-shell, which are mutually coupled so as to form a compartment for accommodating items and can move with respect to each other from at least one open configuration to a closed configuration, characterized in that it comprises at least one transponder, which is suitable to be activated by an appropriately provided reader with a radio frequency signal, said reader being provided at at least one fixed station and being connected functionally to a processing unit, so as to decode the information stored in said transponder and related to the identification of said container and of its contents.

BRIEF DESCRIPTION OF THE DRAWINGS

Further characteristics and advantages of the invention will become better apparent from the following detailed description of a preferred but not exclusive embodiment of a portable carryall container with identifiable contents according to the invention, illustrated by way of non-limiting example in the accompanying drawings, wherein.

DESCRIPTION OF THE PREFERRED EMBODIMENTS

In the exemplary embodiments that follow, individual characteristics, given in relation to a specific example, may actually be interchanged with other different characteristics that exist in other exemplary embodiments.

Moreover, it is noted that anything found to be already known during the patenting process is understood not to be claimed and to be the subject of a disclaimer.

Figure 1:
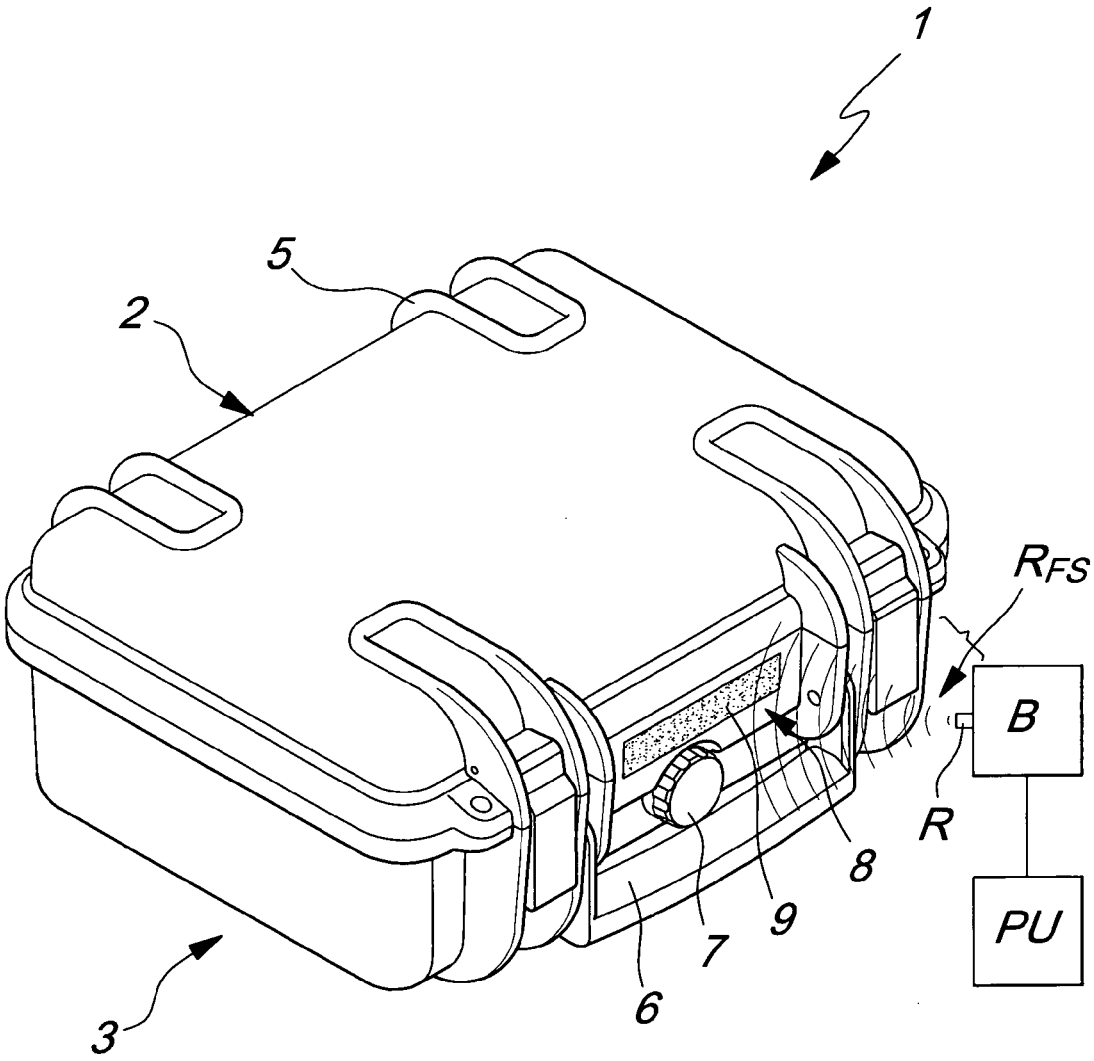
FIG. 1 is a perspective view of a first embodiment of the container according to the invention, in the closed configuration.

With reference to FIG. 1, the reference numeral 1 generally designates a first embodiment of the portable carryall container according to the invention.

FIG. 1 illustrates, for the sake of simplicity, a carryall container which is constituted by a suitcase of a substantially traditional type; the container may actually be constituted, without any exception, by a trunk or any other portable container (for example a bag, a rucksack, et cetera).

Figure 2:
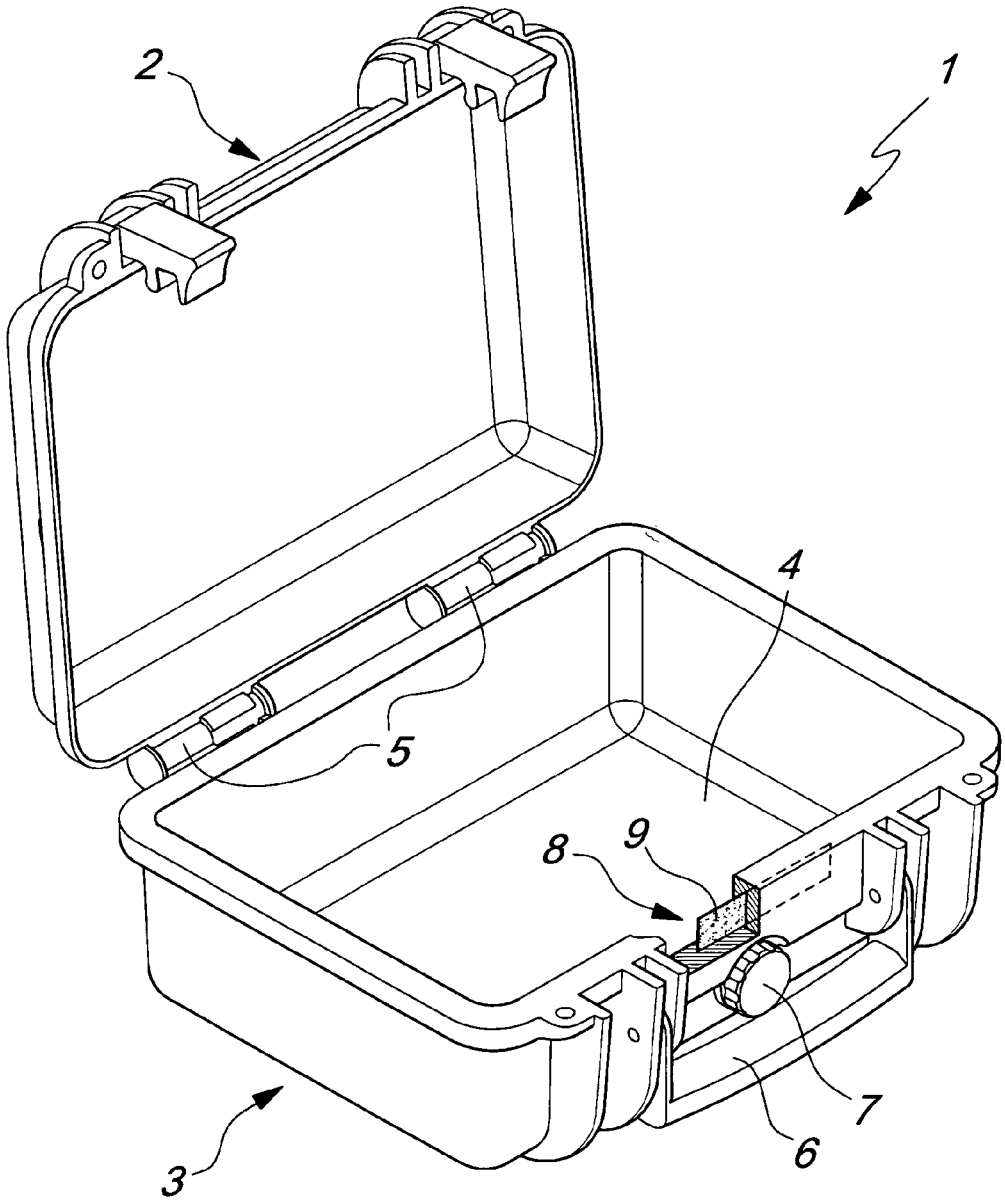
FIG. 2 is a perspective view of a second embodiment of the container, in the open configuration.

The portable carryall container with identifiable contents considered in the embodiment described here is of the type which comprises at least one first half-shell 2, and a second half-shell 3, which are mutually coupled so as to form a compartment for accommodating items 4. The first half-shell 2 and the second half-shell 3 are preferably mutually articulated by means of two hinges 5 and are thus allowed to move with respect to each other from a closed configuration (FIG. 1) to at least one open configuration (FIG. 2). Further, the container is provided conveniently with at least one grip handle 6 and at least one security lock 7.

According to the invention, the portable carryall container comprises advantageously at least one transponder, generally designated by the reference numeral 8, which is suitable to be activated by an appropriately provided reader R, with a radio frequency signal RFS, provided at at least one fixed station B and functionally connected to a processing unit PU. It is thus conveniently possible to decode the information stored in the transponder 8 and related to the identification of said container and of its contents. This information is stored in the transponder 8 by the owner of the container or by anyone else who is responsible for it or entrusted with it.

The fixed station can be constituted for example by an identification device, provided with the reader, which is installed at the entrance of a specific environment or in a strategic position for performing checks or monitoring.

According to the invention, the transponder 8 is constituted by a programmable integrated circuit associated with an antenna. The programmable integrated circuit and the corresponding antenna are preferably of the type activated by the magnetic field generated by said reader.

In greater detail, the integrated circuit of the transponder 8 is of the programmed type with variable data, i.e., of the read/write type. In other words, it is possible, by means of suitable known devices, to store within the circuit the information related to the container and to its contents several times rewritably. However, in a fully equivalent manner, the circuit can be of the programmed type with fixed data, i.e., of the read-only type.

The transponder 8 is rigidly coupled to a thin support, designated by the reference numeral 9, which is preferably made of synthetic material, so as to constitute a sort of label or tag.

In the embodiment of FIG. 1, the transponder 8, together with the support 9, is rigidly coupled to the external surface of the first half-shell 2.

In a fully equivalent manner, they can be rigidly coupled to the external surface of the second half-shell 3.

The method of use of the portable container according to the invention is intuitive. It is in fact sufficient to enter, by means of known devices, in the memory of the integrated circuit of the transponder 8 the information related to the container and to its contents (type of container, quantity and nature of the contained items) in order to ensure, with maximum reliability, that this information is acquired by an appropriate reader and subsequently processed so as to monitor the container and the goods contained therein.

It has thus been shown that the invention achieves the proposed aim and objects.

The invention thus conceived is susceptible of numerous modifications and variations, all of which are within the scope of the appended claims.

A second embodiment of the portable container according to the invention is shown in FIG. 2.

In this embodiment, the transponder 8, together with its support 9, is conveniently integrated in the wall, i.e. thickness of the first half-shell 2 or also of the second half-shell 3. This makes the transponder 8 safer and protects it against possible damage or tampering.

It is noted that the transponder 8 can also be of the type powered by a battery associated with said container.

Actually, the transponder 8 can be positioned in any part of the container if this is advantageous in any way (for example, it can be associated with the handle 6).

All the details may be replaced with other technically equivalent ones.

The embodiment of the present invention shall be carried out in the most scrupulous compliance with the statutory and regulatory provisions related to the products of the invention or correlated thereto and following any required authorization of the corresponding competent authorities, with particular reference to regulations related to safety, environmental pollution and health.

In practice, the materials used, as well as the shapes and the dimensions, may be any according to requirements without thereby abandoning the scope of the protection of the appended claims.

The disclosures in Italian Patent Application No. BO2005A000027 from which this application claims priority are incorporated herein by reference.

What is claimed is:

1. A portable carryall container with identifiable contents, comprising at least one first and one second half-shells, which are coupled to each other so as to form a compartment for accommodating items, said half shells comprising walls with rim regions thereof, each of which with a respective wall thicknesses, and being movable with respect to each other from at least one open configuration to a closed configuration; at least one security lock provided on one of said half-shells on a said rim region and suitable to lock said first and second half-shells in said closed configuration; and at least one transponder, that is rigidly coupled to a thin support and is integrated within the thickness of a wall of said first half-shell or second half-shell in said rim region thereof on which the security lock is provided and in close proximity thereto, said transponder being activatable by an external reader emitting a radio frequency signal, the reader being provided at at least one fixed station and being connected functionally to a processing unit, so as to decode information stored in said transponder that is related to identification of said container and of a contents thereof.

2. The portable container of claim 1, wherein said at least one transponder is constituted by a programmable integrated circuit associated with an antenna.

3. The portable container of claim 2, wherein said programmable integrated circuit and said antenna are provided with and rigidly coupled to said thin support that is made of synthetic material.

4. The portable container of claim 2, wherein said integrated circuit is of a programmed type with read-only fixed data.

5. The portable container of claim 2, wherein said integrated circuit is of a programmed type with read/write variable data.

6. The portable container of claim 1, wherein said at least one transponder is provided suitable to be activated by a magnetic field generated by said reader.

7. The portable container of claim 1, comprising a battery, said at least one transponder being powered by said battery.

8. A portable carryall container with identifiable contents in combination with a reading system comprising: at least one first half-shell and one second half-shell, which are coupled to each other so as to form a compartment for accommodating items, said first and second half-shells comprising walls with rim regions thereof, each of which has a respective thickness and being movable with respect to each other from at least one open configuration to a closed configuration; at least one security lock provided on one of said half-shells on a said rim region and suitable to lock said first and second half-shells in said closed configuration; the reading system comprising at least one fixed station; a processing station; a reader provided at said at least one fixed station; and the container further comprising at least one transponder which is rigidly coupled to a thin support and is integrated within the thickness of a wall of said first half-shell or second half-shell in said rim region thereof on which the security lock is provided and in close proximity thereto, said transponder being activatable by said reader by emission of a radio frequency signal, and wherein said reader is connected functionally to said processing unit, so as to decode information stored in said at least one transponder that is related to identification of said container and of a contents thereof.

* * * * *